US007204527B2

(12) United States Patent
Geurden

(10) Patent No.: US 7,204,527 B2
(45) Date of Patent: Apr. 17, 2007

(54) LOCK COMPRISING TWO LOCKING RODS, IN PARTICULAR FOR VEHICLES

(75) Inventor: Armin Geurden, Grefrath (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 42 days.

(21) Appl. No.: 10/518,134

(22) PCT Filed: Jul. 1, 2003

(86) PCT No.: PCT/EP03/06975

§ 371 (c)(1),
(2), (4) Date: Dec. 15, 2004

(87) PCT Pub. No.: WO2004/007878

PCT Pub. Date: Jan. 22, 2004

(65) Prior Publication Data

US 2005/0225095 A1 Oct. 13, 2005

(30) Foreign Application Priority Data

Jul. 11, 2002 (DE) ..... 102 31 329

(51) Int. Cl.
*E05C 19/10* (2006.01)
*E05C 1/06* (2006.01)

(52) U.S. Cl. ..... 292/122; 292/24; 292/28; 292/141; 292/165; 292/169; 292/171; 292/302; 220/324; 296/37.8

(58) Field of Classification Search ..... 292/122, 292/34, 38, 46, 50, 121, 125, 141, 165, 169, 292/171, 302, DIG. 20, DIG. 38, 39; 220/324, 220/326, 521; 296/37.8, 37.9, 37.12, 37.13
See application file for complete search history.

(56) References Cited

U.S. PATENT DOCUMENTS

| | | | | |
|---|---|---|---|---|
| 722,162 | A * | 3/1903 | St Louis | 292/7 |
| 1,884,201 | A * | 10/1932 | Phillippe | 292/41 |
| 2,146,700 | A * | 2/1939 | Peterson | 292/48 |
| 2,223,760 | A * | 12/1940 | Haaser | 292/48 |
| 3,027,188 | A * | 3/1962 | Eichstadt | 296/51 |
| 3,127,206 | A * | 3/1964 | Jakeway | 292/164 |
| 3,177,022 | A * | 4/1965 | McKee et al. | 292/50 |
| 4,068,871 | A * | 1/1978 | Mercer | 292/48 |
| 5,203,215 | A * | 4/1993 | Baudu et al. | 74/483 R |
| 5,244,238 | A * | 9/1993 | Lindqvist | 292/7 |
| 5,992,188 | A * | 11/1999 | Saunders | 70/120 |
| 6,120,069 | A * | 9/2000 | Taranto | 292/35 |
| 6,669,243 | B2 * | 12/2003 | Katoh et al. | 292/34 |
| 6,817,142 | B2 * | 11/2004 | Marshik | 49/449 |
| 6,877,784 | B2 * | 4/2005 | Kelley et al. | 292/241 |

FOREIGN PATENT DOCUMENTS

| | | |
|---|---|---|
| DE | 2319315 | 10/1974 |
| DE | 4400628 | 7/1995 |
| WO | 9527115 | 10/1995 |

* cited by examiner

*Primary Examiner*—Carlos Lugo
(74) *Attorney, Agent, or Firm*—Friedrich Kueffner

(57) ABSTRACT

A lock having a locking rod that is displaced in a longitudinal direction. The rod is driven by an actuator via a rotor. The internal section of the locking rod is flexible so as to have the properties of a flexural section. The locking rod, together with the flexural section and the rotor are configured in one piece from plastic so as to permit transfer between the rotor and the locking rod that is devoid of play.

20 Claims, 3 Drawing Sheets

LOCK COMPRISING TWO LOCKING RODS, IN PARTICULAR FOR VEHICLES

BACKGROUND OF THE INVENTION

The invention pertains to a lock. At least one longitudinally movable locking bar is provided, which moves in a direction determined by a longitudinal guide. The locking bar is driven by an actuator, which operates by way of a rotor. The outer end of the bar engages in a locking opening in the stationary part of the lock.

In the known lock of this type (WO 95/27115 A1), the two locking bars and the rotor are made as a single piece of plastic, but elastic tabs are used to connect the rotor to the bars. In the assembled lock, these tabs are intended to exert elastic force on the locking bars to keep them in their locking position. This is achieved by producing the two locking bars, the two tabs, and the rotor located between the bars in a stretched-out state and by bringing the tabs into a bent position upon installation in the door, as a result of which they act as leaf springs. A manipulator, which presses against a transverse wall molded onto one of the locking bars and which pivots the rotor by way of the associated tab out of the locking position, is used as an actuator for moving the locking bar. To increase the flexibility of the tabs at the points where they are connected to the rotor, the tabs are made very thin. This negatively affects the strength of the lock; the tabs can break easily at these sensitive connecting points. If this happens, the known lock becomes unusable. The longitudinal guides for the two locking bars consist of strips a certain distance apart, which enclose between them a cross section of the locking bar. No guides are provided in the area of the elastic tabs or in the area of the rotor.

In a lock of a different type (DE 44 00 628 A1), so-called "film hinges" are provided between rigid sections of the locking bars, two rotors, and the connecting bars; these hinges produce a flexible connection between these parts, which are rigid in and of themselves. Film hinges of this type are susceptible to breakage. If a film hinge breaks, the lock is unusable.

In a lock with three bars (DE 23 19 315 A), the two locking bars which move in opposite direction are attached to the bearing ends of two connecting rods, which are connected by elastic bands to a rotor, which can be turned by a key. The rotor, the two elastic bands, and the connecting rods are produced as a single unit out of plastic. When the rotor is turned, the connecting rods can execute a limited pivoting movement inside the lock housing, whereas their bearing ends are guided longitudinally in grooves in the lock housing. The elastic bands extend along radial slots in the rotor and merge with the inner ends of the associated connecting rods. These transition points tend to break easily, however, because of their thinness and because of the load exerted on them during the pivoting movements. The connecting rods have a grooved profile adjacent to their ends, into which the rotor can fit when the connecting rods pivot to the maximum extent. In the minimum pivot position of the connecting rods, their ends are designed to be supported on flattened circumferential areas on the rotor, in which case the elastic bands are bent at a right angle. The locking bars in this case are components which are independent in any case of the gear assembly, and they must be produced separately and then connected in an articulated manner to the two bearing ends of the gear assembly. Play must be allowed between the connecting rods and the locking bars and between the bearing ends and the housing grooves, but this play causes noise when the vehicle is moving.

SUMMARY OF THE INVENTION

The invention is based on the task of developing a low-cost lock which operates reliably, withstands strong loads, and survives many actuating cycles without damage.

In the invention, the inner section of the locking bar is used as an elastic element. This inner section of the locking bar is designed to be flexible and will therefore be referred to in the following as the "flexing section". The flexing section obtains its flexibility through the longitudinal guide of the locking bar, which has a curved course in the area of the rotor. This curvature of the longitudinal guide produces the desired bending of the flexing section upon actuation of the rotor. The rotor itself is molded at a circumferential point onto the lateral flank of the flexing section. The molded connection is not subject to any bending stress and can therefore be made thick enough to be sufficiently sturdy. There is therefore no fear that this connecting point between the flexing section of the locking bar and the circumference of the rotor will break. Upon actuation of the rotor, the flexing section of the locking bar travels to a varying extent into the curved area of the longitudinal guide. The length of the bent part of the flexing section therefore changes.

BRIEF DESCRIPTION OF THE DRAWINGS

Additional measures and advantages of the invention can be derived from the following description, and from the drawings. The invention is illustrated in the drawings on the basis of an exemplary embodiment.

DETAILED DESCRIPTION OF THE INVENTION

Figure 1:
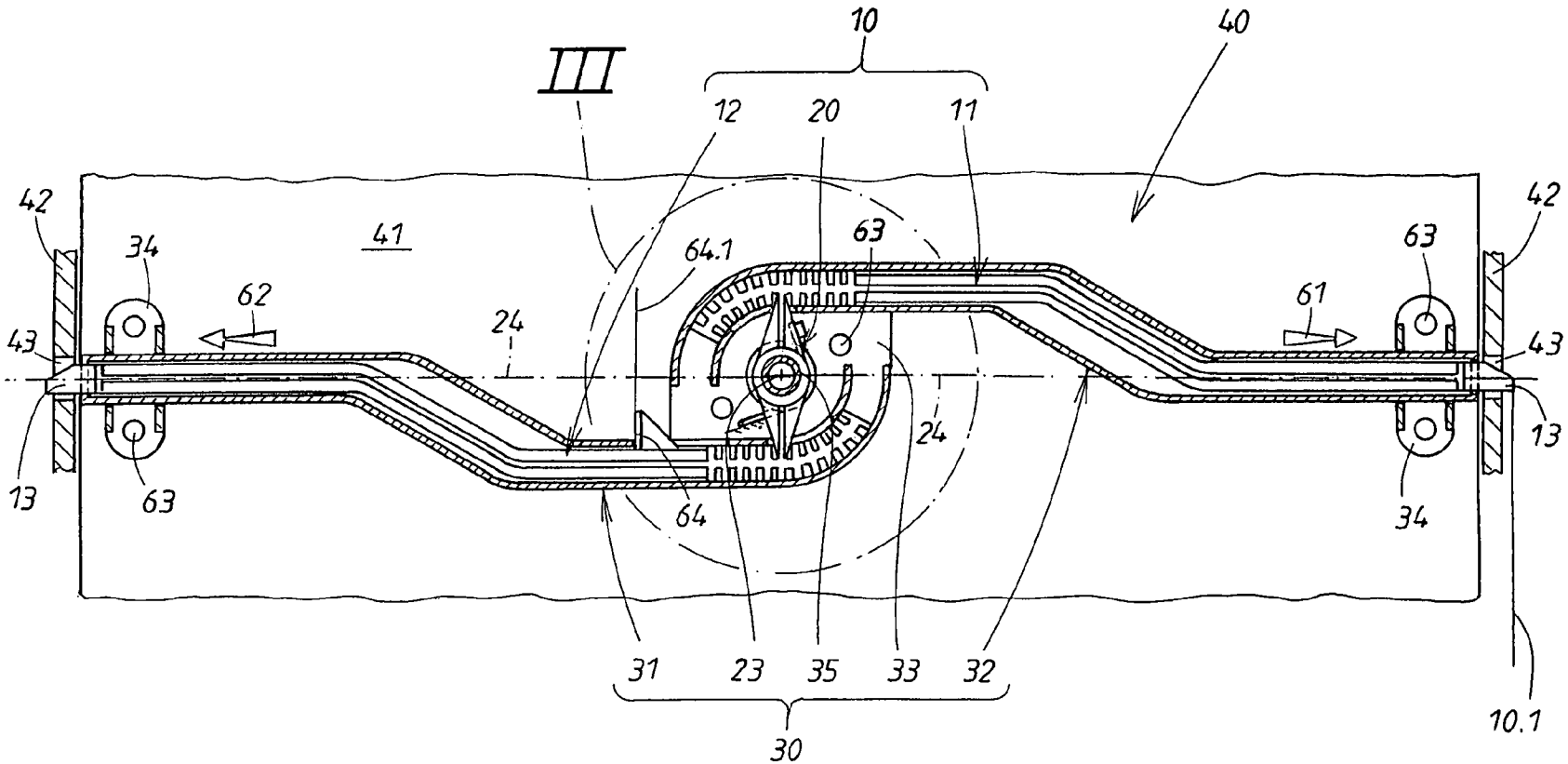
FIG. 1 shows a longitudinal section through the housing with the most essential parts of the inventive lock, which is shown in its locking position.

The exemplary embodiment illustrated in the drawings represents a lock, which, with respect to its most important components, can be divided into two units 10 and 30, which, even though they comprise several elements, are each formed as a single unit. The one unit 10 comprises two locking bars 11, 12, and a rotor 20, located between the bars. Because these components are movable when actuated, they will be referred to in brief below as the "movable unit".

To accept this movable unit 10, a housing-like part is used, which, as can be seen in FIG. 1, can be divided into the following components. First, there is a first guide 31 and a second guide 32 for the two locking bars 11, 12. Between the guides is a carrier 33. Mounting flanges 34 can also be provided on the guides 31, 32 to attach this second unit 30. On the carrier 33 there is a bearing pin 35, which serves as a pivot bearing for the rotor 20. All these components 31 to 35 are designed to form a single unit in the present case, thus forming a common structural unit 30. Because, upon actuation of the lock, the elements of this structural unit 30 remain stationary, this unit will be referred to in brief in the following as the "stationary unit".

As can be seen in FIG. 1, the movable unit 10 is integrated into the stationary unit 30. This integration is accomplished after the two units 10, 30 have been fabricated. For this purpose, the housing-like components of the stationary unit 30 can be opened, e.g., by means of a removable cover, so that the movable unit 10 can be introduced as a whole into the stationary unit 30. After units 10 and 30 have thus been combined, a preassembled combination unit 40 is obtained, which can be attached as a whole either to the movable part or to the stationary part of a door or hatch in a vehicle. In the present case, as FIG. 1 illustrates, the combination unit 40 is attached to the door 41 of a glove compartment. The stationary part 42 consists in the present case of parts of the glove compartment housing. Locking openings 43 are provided in the housing, into which the ends 13 of the bars engage when the lock moves into the locking position shown in FIG. 1. Here, as usual, the locking ends of the bars are located at the outer ends of the bars.

In the present case, the two locking bars 11, 12 are designed as mirror images of each other. It is therefore sufficient to describe their design on the basis of only the one locking bar 11, which will be done with the help of FIG. 2. The description applies analogously to the second locking bar 12.

Figure 2:
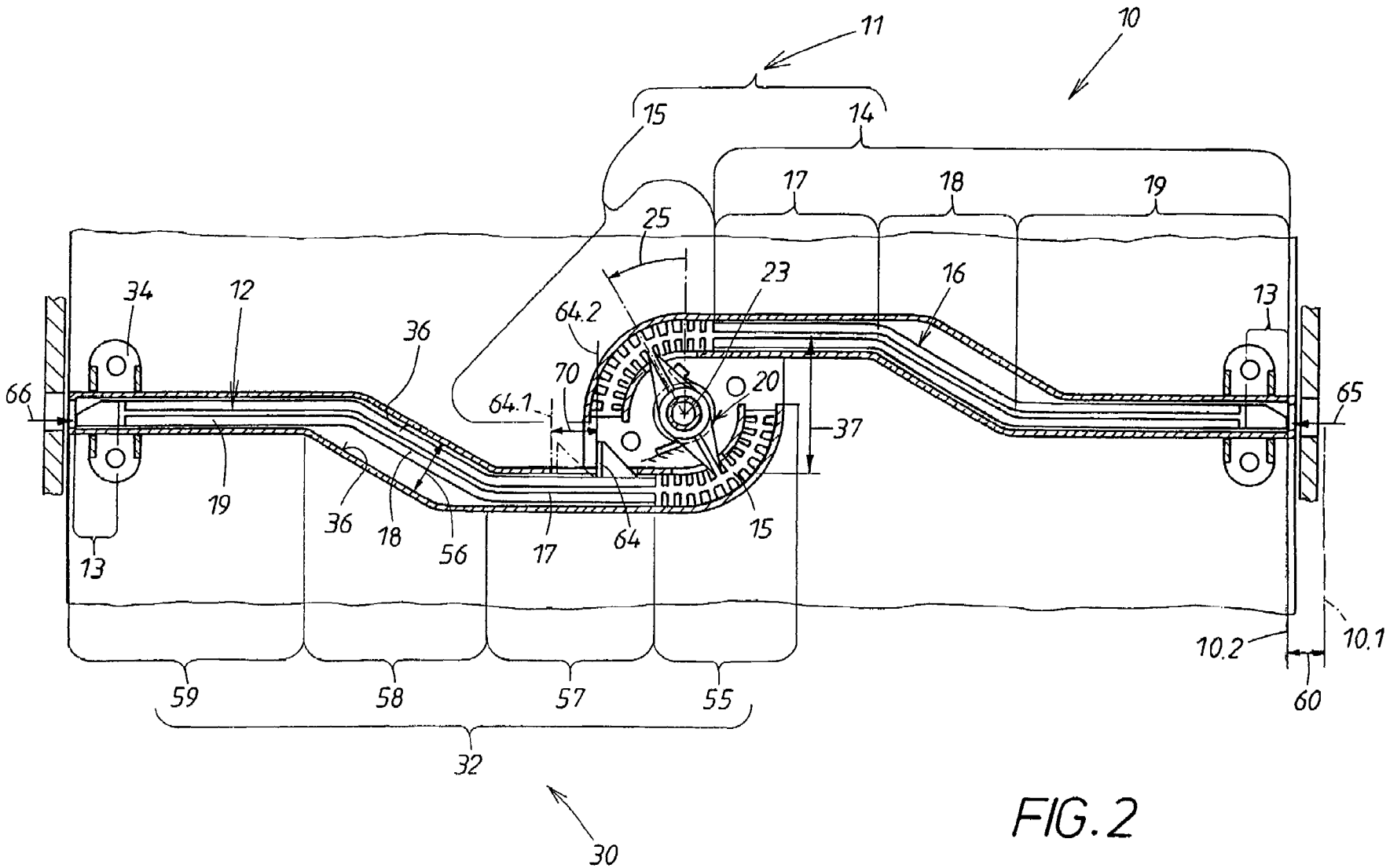
FIG. 2 shows a view corresponding to FIG. 1, in which the lock is in its released position.

In the illustrated exemplary embodiment according to FIG. 2, the locking bar 11 can be divided into two main sections 14, 15, the dimensional stabilities of which differ from each other. Whereas the inner section 15 is designed to be flexible, the adjacent, remaining section 14 is essentially rigid. Because of its deformability, the inner section 15 will therefore be referred to in brief as the "flexing section".

The remaining section 14 of the locking bar is provided with a cranked part 16, which is provided here in the center of the remaining section 14 and therefore divides this section into three subsections 17, 18, 19. The first subsection 17 is adjacent to the outer end of the flexing section 15 and forms a linear extension of it; as can be seen in the enlarged view of FIG. 3, this subsection is essentially tangential to the rotational movement of the rotor, to be described in greater detail later. This movement is illustrated here by the rotational arrow 25.

The third subsection 19 of the rigid remaining section projects straight out at a lateral offset from but parallel to the first subsection 17. The subsection 19 is oriented in such a way that it lies in the radial plane indicated in dash-dot line in FIG. 1, which passes through the axis of rotation 23, marked in the figure, of the rotor 20. The result is that, even though the initial subsections 17 of the two locking bars 11, 12 are laterally offset from each other as indicated at 37 in FIG. 2, their ends 13 nevertheless lie in the previously mentioned radial plane 24.

The previously mentioned cranks 16 allow the subsections 18 to bridge this lateral offset 37. This is achieved by angling the course of these subsections 18, for which reason this section 18 is referred to in brief in the following as the "angled section".

Figure 3:
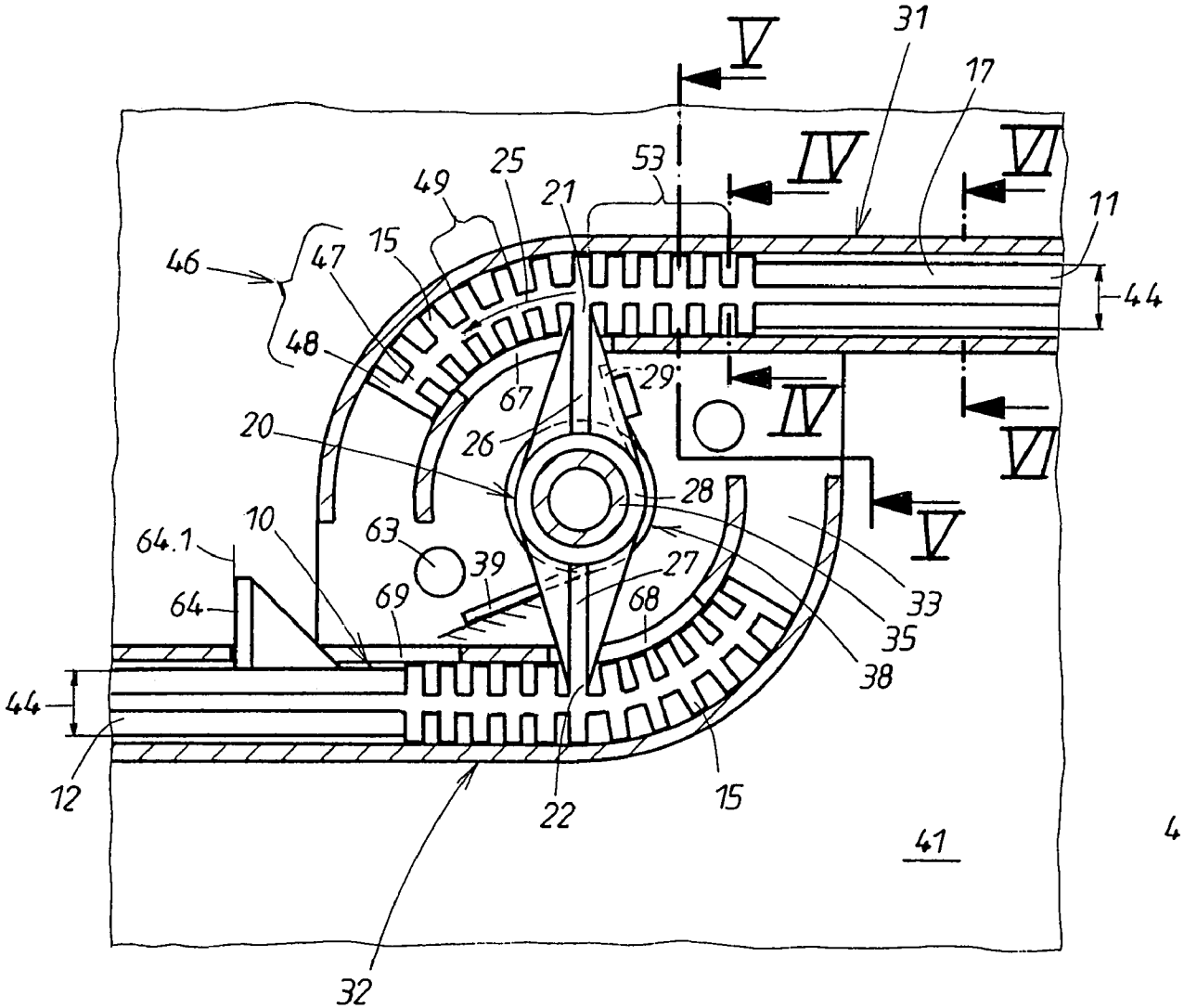
FIG. 3 shows an enlarged view of the central area of this lock, designated "III" in FIG. 1.

The way in which the three elements 11, 12, 20 of the movable unit 10 are held together can be seen most clearly in FIG. 3. This is done, first, in that the two diametrically opposing circumferential points 21, 22 of the rotor 20 are molded onto the flexing sections 15 of the two bars 11, 12. This is done by means of the two radial arms 26, 27, which proceed from a common hub 28 and which are a component of the rotor 20. The previously mentioned circumferential points 21, 22 are in the present case formed by the free ends of these arms, onto which the flexing sections 15 are molded. The flexing sections continue tangentially from there in the form of the straight subsections 17 of the locking bars 11, 12. The two arms 26, 27 lie on the same diameter.

One possibility of fabricating the movable unit 10 consists in forming the flexing sections 25 of the two locking bars 11, 12 out of one type of material and the remaining sections 14 out of a different material. In this case, the material used for the flexing sections 25 would be more flexible than that used for the rigid remaining sections 14. The rotor 20 between the bars would also be molded of this rigid material. The production of components from two different materials by injection molding is known and is referred to as the "two-component process".

According to an exemplary embodiment, it is easier in terms of production to use the same material for both the flexing sections 25 and the remaining sections 14 plus the rotor 20, this material being rigid in and of itself. In this case, the different dimensional rigidities are obtained by providing the components with different profilings. This can be explained best by reference to FIGS. 3–6.

Figure 4:
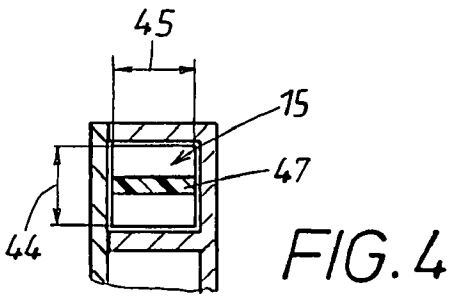
FIGS. 4, 5, and 6 show cross sections through the lock along lines IV—IV, V—V, and VI—VI, respectively, of FIG. 3.
Figure 5:
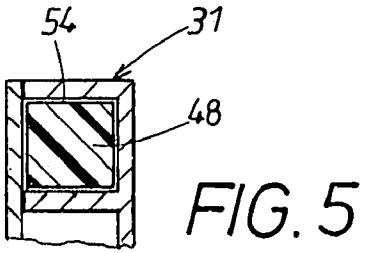
Figure 6:
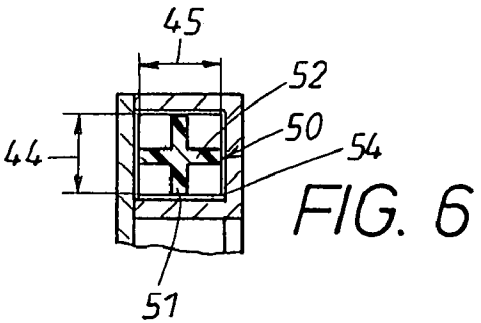

A comparison of FIG. 4 with FIG. 6 shows that the width 44 and the height 45 of the profile in the flexing section 25 are essentially the same as those in the rigid sections 17. The deformability of the flexing section 25 is achieved by a special longitudinal profiling 46 of the flexing section 15. In this area, the cross section is reduced in certain areas, namely, at 47. Here there is a web 47, as can be seen in FIG. 4, which extends down the center of the profile. This web 47 connects two transverse plates 48, the outside edges of which, as can be seen in FIG. 5, are in contact with the inside surfaces of the associated guides 31, 32, to be described in greater detail below. One can think of this longitudinal profiling 46 as consisting of a row of H-shaped pieces 48, which are connected to each other in a polymer-like manner by central webs 47 on both sides.

As previously mentioned, the adjacent subsection 17 already belongs to the remaining, rigid part of the bar, the structure of which can be derived from FIG. 6. Here the bar has a fissured cross section 50, which extends over the entire length of the previously described remaining section 14. In the present case, a cross-shaped profile is provided, consisting of the crossbars 51, 52, which extend in the width and height directions. By dividing the cross section 50 into elements in this way, a large geometrical moment of inertia is obtained with minimal use of material, which ensures the desired rigidity of these remaining sections 14.

Instead of the previously described structure of the movable unit 10, it would also be possible, as an alternative, to provide a flexible connection between the main sections 14 of the two locking bars 11, 12, which are rigid in and of themselves, and the connecting points 21, 22 with the rotor 20. One could, in fact, consider the transition area of the flexing section 15 characterized by the number 53 in FIG. 3 as already representing a "flexible connection" of this type. This connection could alternatively consist of a so-called "film hinge" between the rotor 20 and the rigid initial section 17 of the rigid locking bar 11, 12. One could then either dispense completely with the guides 31, 32 or limit these guides to certain areas of support for the rigid remaining sections 14 of the two locking bars.

As can be seen in FIGS. 4–6, each guide 31, 32 consists of a channel 54, which encloses the previously described cross sections 48, 50 on all sides. In the present case, as will be explained in greater detail on the basis of the second guide 32 of FIG. 2, the guide is designed in the following special way. Each of the two guides 32 has, first, a curved section 55, which is concentric to the axis of rotation 23 of the rotor. The curved section 55 is made just long enough to accommodate the flexing section 15 after the movable unit 10 and thus the ends 13 of the bars have been brought into the release position, as illustrated by the auxiliary line 10.2 in FIG. 2. In this situation, the rotor 20 has completed the previously mentioned rotational movement 25 away from the starting position shown in FIG. 1. The movable unit 10 is in its locking position in FIG. 1, as marked by the auxiliary line 10.1. In this case, the previously described connecting piece 53 of the flexing section 15 projects into the adjacent channel piece 57 according to FIG. 1, which, as can be seen in FIG. 2, is tangential to the curved section 55. This channel piece 57 serves primarily to accommodate the initial rigid section 17 of the associated locking bar 12, 11.

This is followed by a channel piece 58, which accepts the previously described angled section 18 and therefore has a larger open width 56. The width 56 is greater than/equal to the length of the stroke 60 shown in FIG. 2 between the two end positions 10.1, 10.2 of the movable unit 10. If necessary, the lateral channel walls 36 can serve to limit this longitudinal stroke 60.

This expanded third channel section 58 is followed, finally, by a last section 59, which serves as a longitudinal guide for the outermost section 19 of the locking bar, at the end of which the previously mentioned bar end 13 is located. This last channel section 59 lies on the previously described radial plane 24 of FIG. 1, which passes through the rotor 20.

The one-piece movable unit 10 is subject to the action of a restoring force, which tries to move the two locking bars 11, 12 in opposite directions as indicated by the force arrows 61, 62 of FIG. 1. The restoring spring used for this purpose can act at any desired point. Because of the special one-piece design of the entire unit 10, it is recommended for this purpose that a common shank spring 38 be used, the first shank 29 of which is supported on the rotor 20, whereas the second shank 39 is supported on the carrier 33. This shank spring 38 wraps around the bearing pin 35, which, as previously mentioned, is seated on the carrier 33 and forms an integral part of the stationary unit 30. The carrier 33 ensures that the two guides 31, 32 are held in position, and it is also provided with mounting holes 63. Similar mounting holes 63 are also located in the mounting flanges 34, which, according to FIG. 2, are provided at the end of each of the guides 32, that is, on the last channel sections 59.

A common actuator, which is not shown but which can consist of, for example, a handle to be pulled or turned, is provided for the two locking bars. It is sufficient for the actuator to act on one of the two locking bars 12 or 11, because they are both connected to the rotor 20, which synchronizes the movement of the two bars 11, 12. Because of the special one-piece design of the movable unit, this synchronized movement is free of play and free of rattling. In the present case, the attack point for the actuating end of an actuator of this type is a shoulder 64, which is seated in an axially fixed position on the second locking bar 12. In the normally present locking position 10.1 of the movable unit 10, the shoulder 64 is located in its rest position, marked by the auxiliary line 64.1 in FIGS. 1 and 3. By means of the previously mentioned actuator, the shoulder is moved as illustrated in FIG. 2 into its working position, indicated by the auxiliary line 64.2. As a result, the locking bars are moved in opposite directions, as indicated by the motion arrows 65, 66, and enter the associated channels 31, 32 of the stationary unit 30.

To make it possible for the mounted rotor 20 to rotate in the guides 31, 32, openings 67, 68 are provided in the walls of the guides for the two arms 26, 27. In a similar manner, a cutout 69 is provided in the guide 32 to allow the longitudinal displacement of the shoulder 64; this cutout is made long enough to allow the longitudinal movement 70 shown in FIG. 2 between the two positions 64.1 and 64.2 of FIG. 2.

LIST OF REFERENCE NUMBERS

10 first structural unit, one-piece movable unit
10.1 locking position of 10 (FIGS. 1, 3)
10.2 release position of 10 (FIG. 2)
11 first locking bar of 10
12 second locking bar of 10
13 ends of locking bars 11, 12
14 rigid main sections of 11, 12, remaining sections (FIG. 2)
15 flexible main sections of 11, 12, inner flexing sections (FIG. 2)
16 cranked sections of 11, 12
17 first subsection of 14, inner section (FIG. 2)
18 second subsection of 14, central angled section (FIG. 2)
19 third subsection of 14, outer section (FIG. 2)
20 rotor
21 first circumferential point of 20 (FIG. 3)
22 second circumferential point of 20 (FIG. 3)
23 axis of rotation of the rotor 20 (FIGS. 1, 2)
24 radial plane passing through 23, for 19 (FIG. 1)
25 arrow of the rotation of 20 (FIG. 3)
26 first radial arm of 20 at 21 (FIG. 3)
27 second arm of 20 at 22 (FIG. 3)
28 hub of 20
29 first shank of spring 38, on 20 (FIG. 3)
30 second structural unit, stationary unit
31 first guide of 30, for 11
32 second guide of 30, for 12
33 carrier between 31 and 32 (FIG. 3)
34 mounting flanges on 31, 32 (FIG. 1)
35 bearing pin for 20 (FIG. 3)
36 inner channel wall at 58 (FIG. 2)
37 lateral offset between sections 17 of 11 and 12 (FIG. 2)
38 shank spring for 61, 62 (FIG. 3)
39 second shank of spring 38, on 33 (FIG. 3)
40 combination unit consisting of 10 and 30 (FIG. 1)
41 movable part, door
42 stationary part, housing
43 locking opening in 42 for 13 (FIG. 1)
44 outside width of profile of 25 or 17 (FIGS. 4, 5)
45 outside height of profile of 25 or 17 (FIGS. 4, 5)
46 longitudinal profiling of 15 (FIG. 3)
47 web of 46 in 15 (FIG. 3)
48 transverse plate of 46 in 15 (FIG. 3)
49 H-shaped piece consisting of 47, 48 (FIG. 3)
50 fissured cross section of 14, 17 (FIG. 6)
51 first crossbar of 50 (FIG. 6)
52 second crossbar of 50 (FIG. 6)
53 flexible connection at 15 (FIG. 3)
54 channel for 31, 32 (FIGS. 5, 6)
55 first channel piece of 32 or 31, curved section (FIG. 2)
56 open width of 58 (FIG. 2)
57 second channel piece, for 17, tangential piece (FIG. 2)
58 third channel piece, for 18, expanded channel piece (FIG. 2)
59 fourth channel piece, for 19, last channel piece (FIG. 2)
60 stroke of 13 (FIG. 2)
61 force arrow for 11 (FIG. 1)
62 force arrow for 12 (FIG. 1)
63 mounting holes in 33 and 34 for 30 and 40 (FIG. 1)
64 shoulder on 12 (FIG. 1)
64.1 rest position of 64 (FIGS. 1, 2)
64.2 working position of 64 (FIG. 2)

65 arrow of the inward travel of 11 (FIG. 2)
66 arrow of the inward travel of 12 (FIG. 2)
67 cutout in 31 for 26 (FIG. 3)
68 cutout in 32 for 27 (FIG. 3)
69 cutout in 32 for 34 (FIG. 3)
70 longitudinal movement of 64 (FIG. 2)

The invention claimed is:

1. A lock, especially for vehicles, for locking a movable part such as a pivoting door (41) to a stationary part such as a housing (42), the lock comprising:

at least one longitudinally movable locking bar (11, 12), which is driven by a rotor (20);

where the locking bar (11, 12) has a flexible inner section (15) and a rigid outer remaining section (14);

the rotor (20) having a circumferential point (21, 22) that engages a lateral flank of the flexing section (15) of the locking bar (11, 12);

a locking opening (43) in the stationary part (42), into which an outer end (13) of the remaining section (14) travels to produce a locking effect;

longitudinal guide (31, 32) for the locking bar (11, 12), the longitudinal guide being configured to deform the flexible section (15) of the locking bar (11, 12) during longitudinal movement of the bar, the longitudinal guide (31, 32) having a first, curved course (55) essentially coaxial to the axis of rotation (23) of the rotor (20), and a linear second course (57) extending from and running tangential to the curvature of the first course, wherein the first course (55) accommodates the flexible section (15) and forms the flexible section (15) into a ring segment that is coaxial to the axis of rotation (23) of the rotor (20), and the second course (57) stretches and stiffens the flexible section (15) in order to transfer a force load from the rotor (20) to the remaining section (14) of the locking bar (11, 12).

2. A lock according to claim 1, wherein, in the area of the flexing section (15), the part of the longitudinal guide (31, 32) adjacent to the curved guide piece (55) is essentially tangential (57) to the rotation (25) of the rotor (20).

3. A lock according to claim 1, wherein at least a certain part of the flexing section (15) is seated tangentially on the free end of an arm (26, 27) of the rotor (20).

4. A lock according to claim 1, wherein the locking bar or bars (11, 12) have a cranked part (16).

5. A lock according to claim 4, wherein the end (13) of the bar responsible for the locking action extends in a direction which is essentially radial (24) with respect to an axis of rotation (23) of the rotor (20); and in that the locking bar (11, 12) has a central angled section (18), which proceeds at an angle to the longitudinal movement (65, 66) of the bar, which angled section bridges the radial distance (37) to the inner flexing section (15) of the locking bar (11, 12).

6. A lock according to claim 1, wherein a pivot bearing (35) of the rotor (20) is seated on a carrier (33), and in that the carrier (33) is designed to form a one-piece part with the guide (31, 32) for the locking bar or bars (11, 12).

7. A lock according to claim 6, wherein the pivot bearing of the rotor (20) consists of a bearing pin (35), and in that the bearing pin (35) is designed to form a one-piece part with the carrier and the guide (31, 32).

8. A lock according to claim 1, wherein the longitudinal guides (11, 12) are designed in the form of channels.

9. A lock according to claim 8, wherein the guide channel (31, 32) extends over essentially the entire length of the locking bar (11, 12), all the way to the outer end (13) responsible for the locking action.

10. A lock according to claim 9, wherein the guide channel (31, 32) has a channel piece (58), which also encloses an angled section (18) of the locking bar (11, 12); and in that this channel piece (58) has an open width (56) which is greater than or equal to a stroke (60) of the locking bar (11, 12) during its longitudinal movement (65, 66).

11. A lock according to claim 10, wherein the lateral channel walls (36) of the channel piece (58) limit the longitudinal stroke (16) of the locking bar or bars (11, 12).

12. A lock according to claim 1, wherein the longitudinal guides (31, 32) are provided in certain areas with flanges (34), which serve to attach the lock to the movable or resting part (41,42).

13. A lock according to claim 1, wherein the lock consists of two structural units (10, 30), which, although consisting of multiple elements, are designed to form a single piece, namely, a movable unit (10), comprising the locking bar or bars (11, 12) with their flexing sections (15), onto which the rotor (20) is molded; and a stationary unit (30), comprising a pivot bearing (35) for the rotor (20); the longitudinal guide or guides (31, 32) for the locking bars (11, 12); and possibly a carrier (33), which is installed between the bars, and the fastening flange (34).

14. A lock according to claim 1, wherein the locking bar or bars (11, 12) consist of two different materials, where the material in the area of the flexing section or sections (15) is designed to bend more easily than the material of the remaining bar (14).

15. A lock according to claim 1, wherein the flexing section or sections (15) of the locking bars (11, 12), together with the rigid remaining bar (14) and the rotor (20), are all made of the same material, which is dimensionally stable in and of itself, with the difference that the flexing section or sections (15) have a profiling (46), which makes this area flexible.

16. A lock according to claim 15, wherein the locking bar (11, 12) has a maximum outside profile width (44) in the flexing section (15) which is essentially the same as the width of the rigid sections (14) of the bar; and in that the flexing section (15) has longitudinal profiling (46), which reduces the cross section of the locking bar (11, 12) in certain areas.

17. A lock according to claim 16, wherein, when seen from above, the longitudinal profiling (46) of the flexing sections (15) consists of H-shaped pieces (49) arranged in a row so as to resemble a polymer chain.

18. A lock according to claim 16, wherein the essentially rigid sections (14) of the locking bar (11, 12) have a fissured cross section (51, 52), which extends uniformly over essentially the entire length of the section.

19. A lock according to claim 18, wherein the fissured cross section has the profile of a cross (51, 52), the ends of the crossbeams being supported against the inside surfaces of the longitudinal guides (31, 32).

20. A lock according to claim 1, wherein the locking bar (11, 12) with the inner and outer section (14, 15), and the rotor (20) are formed as a one-piece part, the rotor (20) being formed on the locking bar (11, 12).

* * * * *